US006109699A

United States Patent [19]

Mraz

[11] Patent Number: 6,109,699

[45] Date of Patent: Aug. 29, 2000

[54] TOW LINE EQUIPPED REMOTE MINING MACHINE AND METHOD

[75] Inventor: Dennis Mraz, Saskatoon, Canada

[73] Assignee: DM Technologies, Ltd., Sasakatoon, Canada

[21] Appl. No.: 09/139,026

[22] Filed: Aug. 24, 1998

[51] Int. Cl.[7] ..... E21C 35/24

[52] U.S. Cl. ..... 299/10; 299/30; 104/173.1; 191/12.2 R

[58] Field of Search ..... 104/173.1, 178, 104/183; 191/12.2; 299/10, 30, 64

[56] References Cited

U.S. PATENT DOCUMENTS

| | | | |
|---|---|---|---|
| 3,456,982 | 7/1969 | Reilly | 299/30 |
| 3,603,264 | 9/1971 | Arx | 104/138.2 |
| 4,172,615 | 10/1979 | Hakes | 299/30 |
| 4,192,551 | 3/1980 | Weimer et al. | 299/30 |
| 4,365,927 | 12/1982 | Schenck | 104/183 |
| 4,583,700 | 4/1986 | Tschurbanoff | 191/12.2 R |
| 4,846,320 | 7/1989 | Clarke | 191/12 R |
| 5,582,465 | 12/1996 | Mraz . | |

FOREIGN PATENT DOCUMENTS

| | | | |
|---|---|---|---|
| 1347573 | 5/1988 | U.S.S.R. | 299/64 |

*Primary Examiner*—Eileen D. Lillis
*Assistant Examiner*—John Kreck
*Attorney, Agent, or Firm*—Swidler Berlin Shereff Friedman, LLP

[57] ABSTRACT

A method and apparatus for advancing cables and hoses to a remotely operated mining machine and retrieval of the machine in case of accident, and for remote haulage of material in a self-propelled vehicle guided within a mine opening, so as to avoid interference with cables and hoses and the walls of mine opening.

9 Claims, 13 Drawing Sheets

SECTION *II*

TOW LINE EQUIPPED REMOTE MINING MACHINE AND METHOD

FIELD OF THE INVENTION

The present invention relates generally to mining and specifically to haulage in remote mining of bedded mineral deposits.

BACKGROUND OF THE INVENTION

Most methods of remote mining in bedded mineral deposits such as coal seams employ a mining machine that advances parallel mine openings some distance from the seam exposure on the surface leaving supporting pillars between the openings. The excavated mineral is hauled to the surface, in some instances by a remotely operated Load-Haul-Damp vehicle or LHD. For example LHD haulage assisted by a winch is described in U.S. Pat. No. 5,582,465 to Mraz.

The remote operation of LHD using commonly available remote controls is feasible. However, in order to achieve efficient LHD haulage to a desirable distance such as 1,000 feet or more, the speed of haulage must be considerable. Typically, the average speed of LHD haulage must be greater than 400 feet per minute. Often in remote mining methods the LHD vehicle has to operate within confined mine openings, making it difficult to steer the LHD remotely without collisions with pillar walls, and thus disrupting the haulage, reducing the haulage rate and possibly causing damage to the equipment. Therefore, it would be desirable to obtain a method of guidance that would assure efficient guiding of the LHD during the remote operation.

Both the LHD and the mining machine may require services such as power, control, water and compressed air. Service lines which supply these services may include ropes, cables, electrical cables, and hoses, and are usually located in the mine opening where they may be damaged if they lay in the path of the LHD. Where the mine floor is soft, repeated trips of the LHD to the mining face and back may cause depressions in the mine floor. Such depressions may cause the service lines to slide into them and interfere with the path of the LHD. It would be therefore desirable to prevent depressions resulting from LHD haulage in the mine floor to avoid interference between the LHD and service lines, and also provide a navigable path for the LHD.

Most of the currently available LHD'S, such as shuttlecars, are powered electrically and carry a cable winder for the power cable or service line, which is unwound as the LHD advances into the face and wound in as it retreats. The LHD power cable is frequently referred to as a trailing cable. The capacity of LHD cable winders is currently limited to about 850 feet of power cable, which limits the depth of remote mining. The present practice with manually operated LHD's is to arrange a so called holdback, where the end of the LHD cable is connected to power at about half the distance of haulage. Thus the LHD can wind the cable in, up to the position of the holdback, and unwind it beyond that point, which practice can effectively double the distance of haulage. It would be therefore desirable to advance a remote cable holdback along the mine opening.

Where haulage for remotely operated mining machine is provided by a conveyor, service lines can be carried on the structure of the conveyor. This is not possible with LHD haulage. As well, to position several service line winders on a remotely operated mining machine is not practical, particularly if the depth of mining is considerable. It is also not desirable for the mining machine to drag the service lines along while it is advancing, as their considerable weight would prevent the mining machine from efficient excavation. Therefore, it would be desirable to advance the service lines as well as the above-mentioned holdback during the remote mining operation without impeding the advancement of the mining machine.

SUMMARY OF THE INVENTION

An object of the present invention is therefore to provide an efficient guidance to LHD within a mine opening during a remote haulage operation.

Another object of the present invention is to prevent interference between LHD vehicle and the mining machine's service lines.

Another object of the present invention is to prevent creation of depression in the path of the LHD vehicle's wheels.

Another object of the present invention is to remotely advance service lines and LHD cable holdback to the remotely operated mining machine without impeding its efficient operation.

Yet another object of the present invention is to retrieve a remotely operated mining machine in case of breakdown or accident.

These and other objects of the present invention are met by: providing mechanical guides and electronic sensors on the remotely operated LHD that are capable of guiding it within the mine opening in a desired position; installing a plow on the LHD capable of removing excess floor material from the space between the wheels and moving it to the path of the wheels; mounting mining machine service lines and LHD cable holdback on a tow line, remotely advancing the tow line toward the remotely operated mining machine without impeding its ability to advance into the face during the excavation and providing means of remotely positioning the mining machine service and tow lines at the center of a remotely operated mining machine in order to facilitate retrieval of the machine in case of a breakdown. The tow line is any type of line, optionally a component line of the service line, to which service lines, or the remainder of the service lines are attached, and by which the service lines are advanced or withdrawn from the mine opening.

DETAILED DESCRIPTION OF THE PREFERRED EMBODIMENTS

Figure 1:
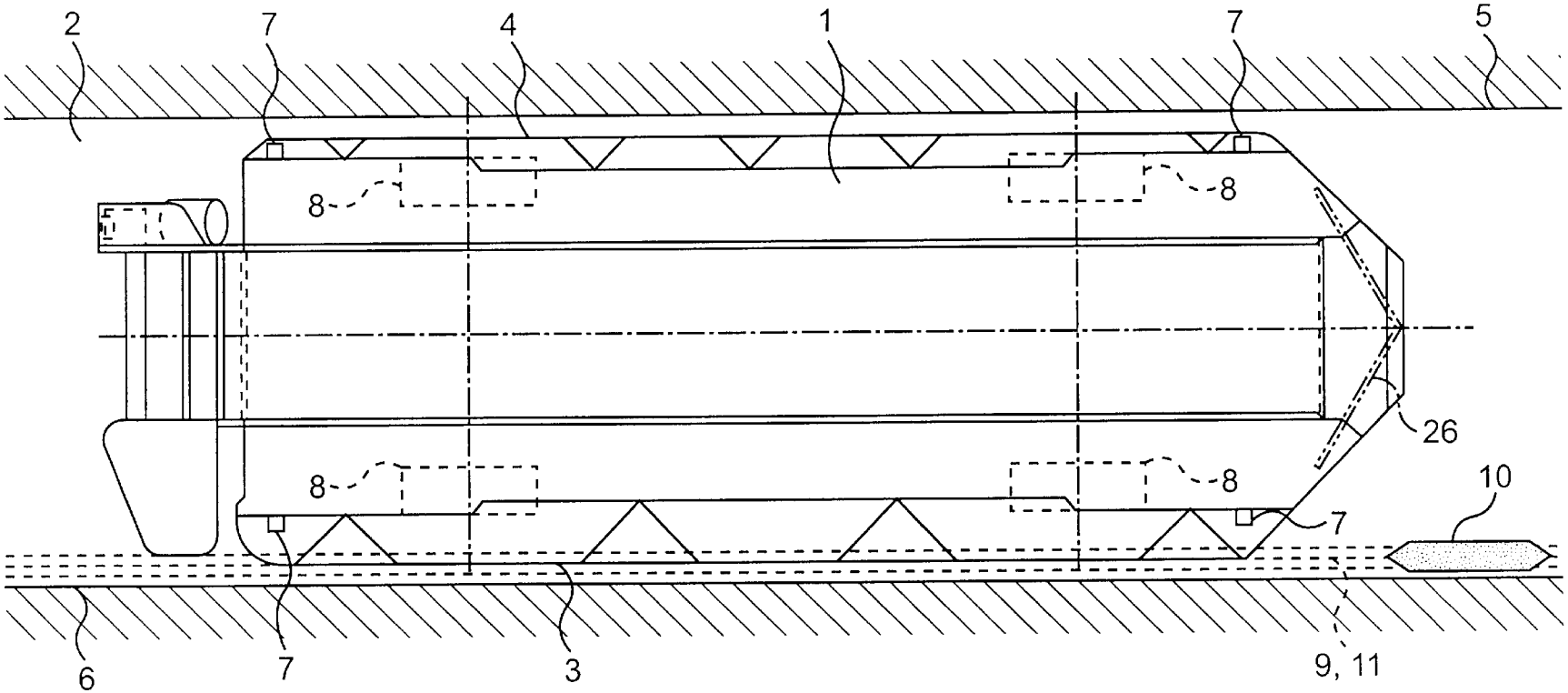
FIG. 1 is a schematic plan view of a preferred embodiment of a remotely operated LHD with mechanical guides, position sensors and a plow for removing excess floor material.
Figure 2:
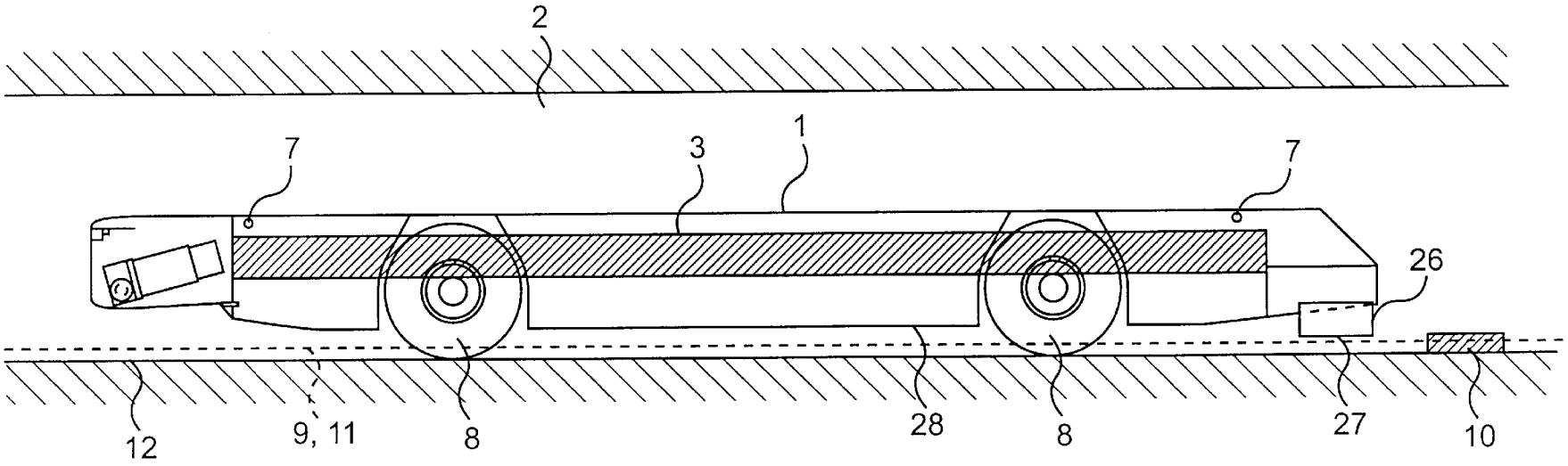
FIG. 2 is a schematic side view of a preferred embodiment shown in FIG. 1.
Figure 3:
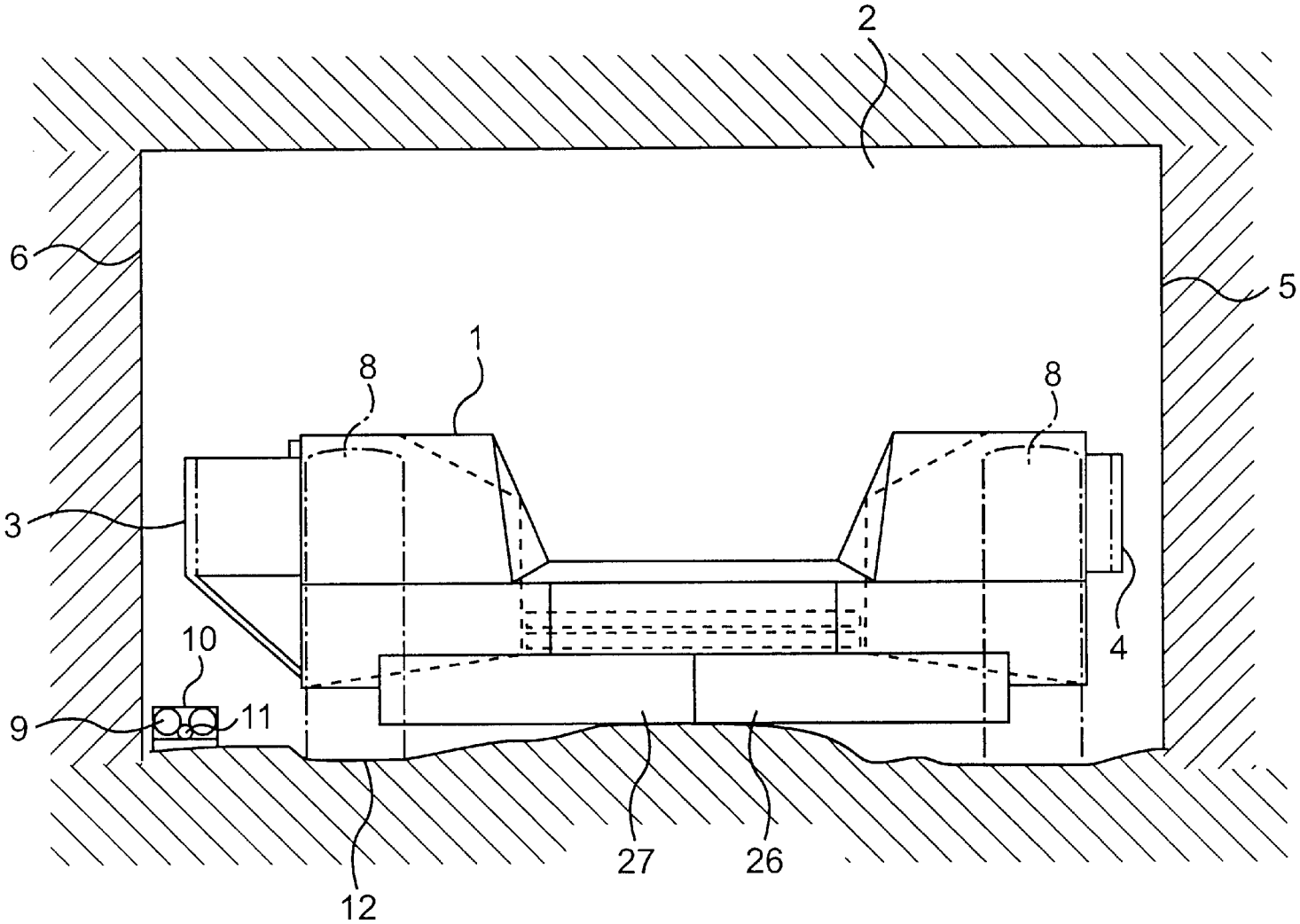
FIG. 3 is a schematic cross-sectional view of a preferred embodiment shown in FIG. 1.

Referring to FIGS. 1 through 3, the LHD 1 operates remotely within a mine opening 2. Mechanical guides 3 and 4 mounted on the sides of LHD 1 are positioned substantially parallel to the walls 5 and 6. Position sensors 7, such as sonic proximity sensors or laser proximity sensors, sense the position of the walls 5 and 6, and which position information is used to operate wheels 8 of the LHD 1, automatically assuring that the LHD I maintains a desired position within the mine opening 2. Alternatively, sensors 7, may detect the position of a laser guidance beam directed along the length of the mine opening. If the action of sensors 7 is too slow or if they fail to operate properly, the mechanical guides 3 and 4 maintain the desired position of the LHD 1 by rubbing against the walls 5 and 6 when the LHD deviates from a desired position and prevents the LHD from running over the service line. Service line 9 attached with clamps 10 to a tow line 11 is located adjacent to the wall 6 on the floor 12 of the mine opening 2. A plow 26 is installed at the end of the LHD 1 with the lower edge 27 positioned below the level of the bottom 28 of the LHD 1. If repeated trips of the LHD 1 or material spilled from LHD 1 or other debris causes the floor 12 to be uneven and unnavigable by the LHD 1, the plow 26 plows excess material into the path of wheels 8 thus maintaining sufficient clearance between the floor 12 and the LHD 1.

Figure 4:
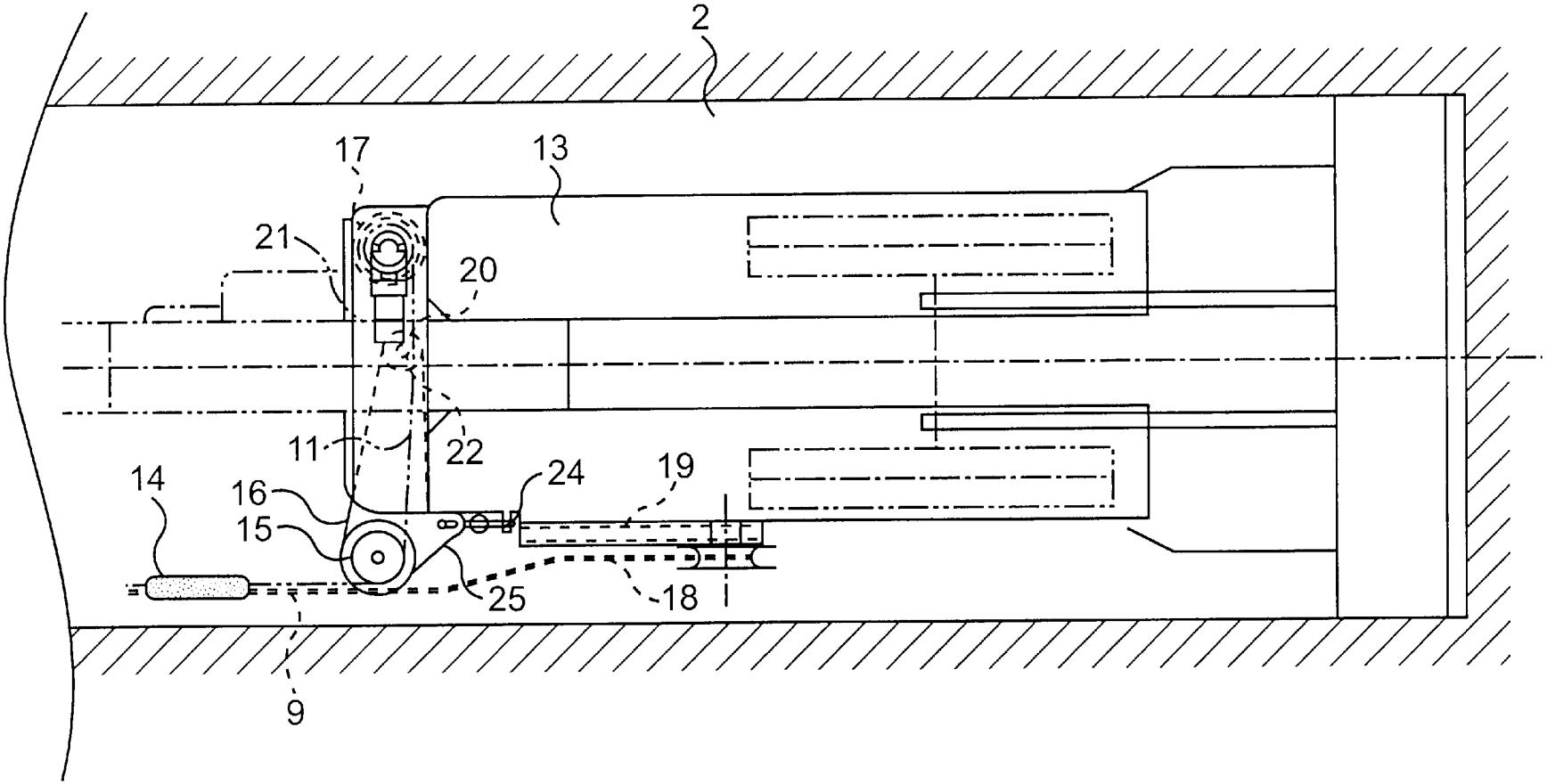
FIG. 4 is a schematic plan view of a preferred embodiment of a remotely operated mining machine with a tow line winder and a releasable tow line diverter.
Figure 5:
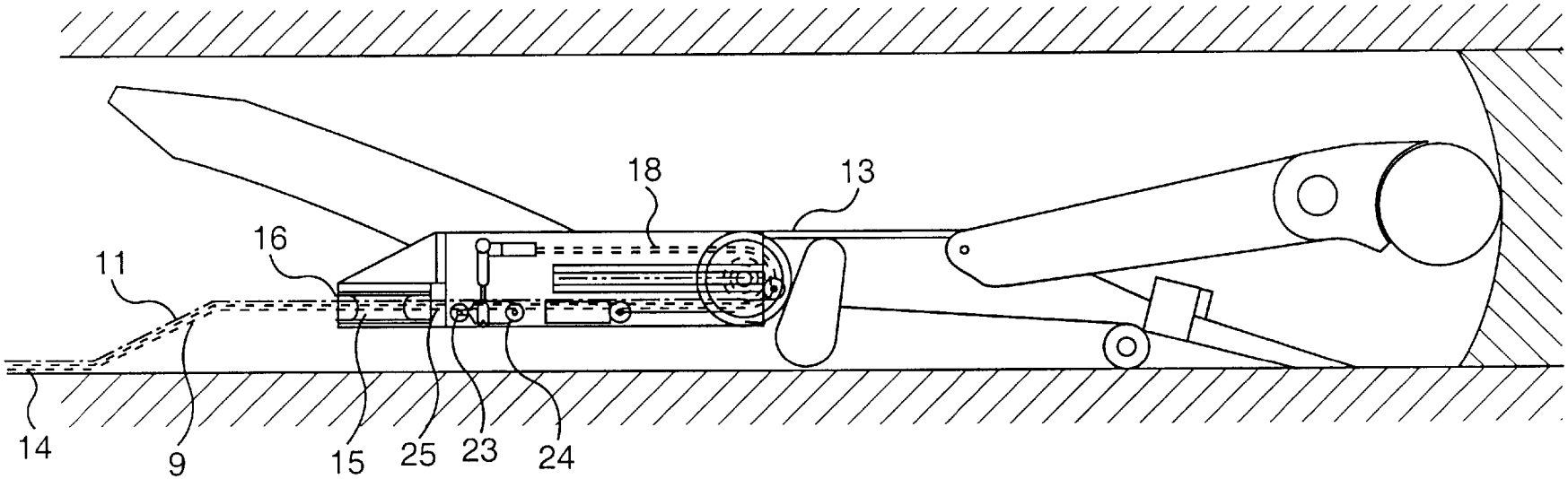
FIG. 5 is a schematic side view of a preferred embodiment shown in FIG. 4.

Referring to FIGS. 4 and 5, the remote mining machine 13 is advancing a mine opening 2. Service line 9 supplying power and other services to the remote mining machine 13 are attached to a tow line 11. The last clamp 14 is located a small distance, typically several feet, from the sheave 15 of the tow line diverter 16. The end of the tow line 11 is wound on a tow line winch 17, capable of winding and unwinding a length of tow line, for example about 20 feet of tow line 11. On the sheave 15 the service line 9 separates from the tow line 11 and forms a loop 18 within the service line take-up 19 capable of storing certain length of service line 9, equal to the length of one advance cycle, typically about 10 feet. When the remote machine 13 advances within the mine opening 2, the tow line winch 17 allows the tow line 11 to unwind while the service line take-up 18 releases required length of service line 9. When the remote machine 13 advances the length of one advance cycle, it stops and the winch 17 winds in a required length of tow line 11 while the service line take up 19 pulls in the full length of the loop 18. This allows the next advance cycle to begin. Because the remote mining machine is stationary while the service line 9 is being advanced, the excavating operation of the remote mining machine 13 is not adversely affected by the pulling force of the tow line 11 and service line 9. One end 20 of the tow line diverter 16 is mounted and hinged within the bumper 21, in this instance with a pin 22. A locking mechanism 24 engages the tow line diverter 16, holding it in a side position as shown, in order to divert the tow line 11 to the side of the mine opening 2. The locking mechanism my be remotely actuated by electrical or hydraulic actuators. Alternatively the locking mechanism may comprise a shear pin which is sheared by pulling the tow line, thus releasing the diverter from the side position. The pulling force on the tow line needed to break the shear pin would be greater than that needed to advance the tow line, but less than that needed to move the mining machine.

Figure 6:
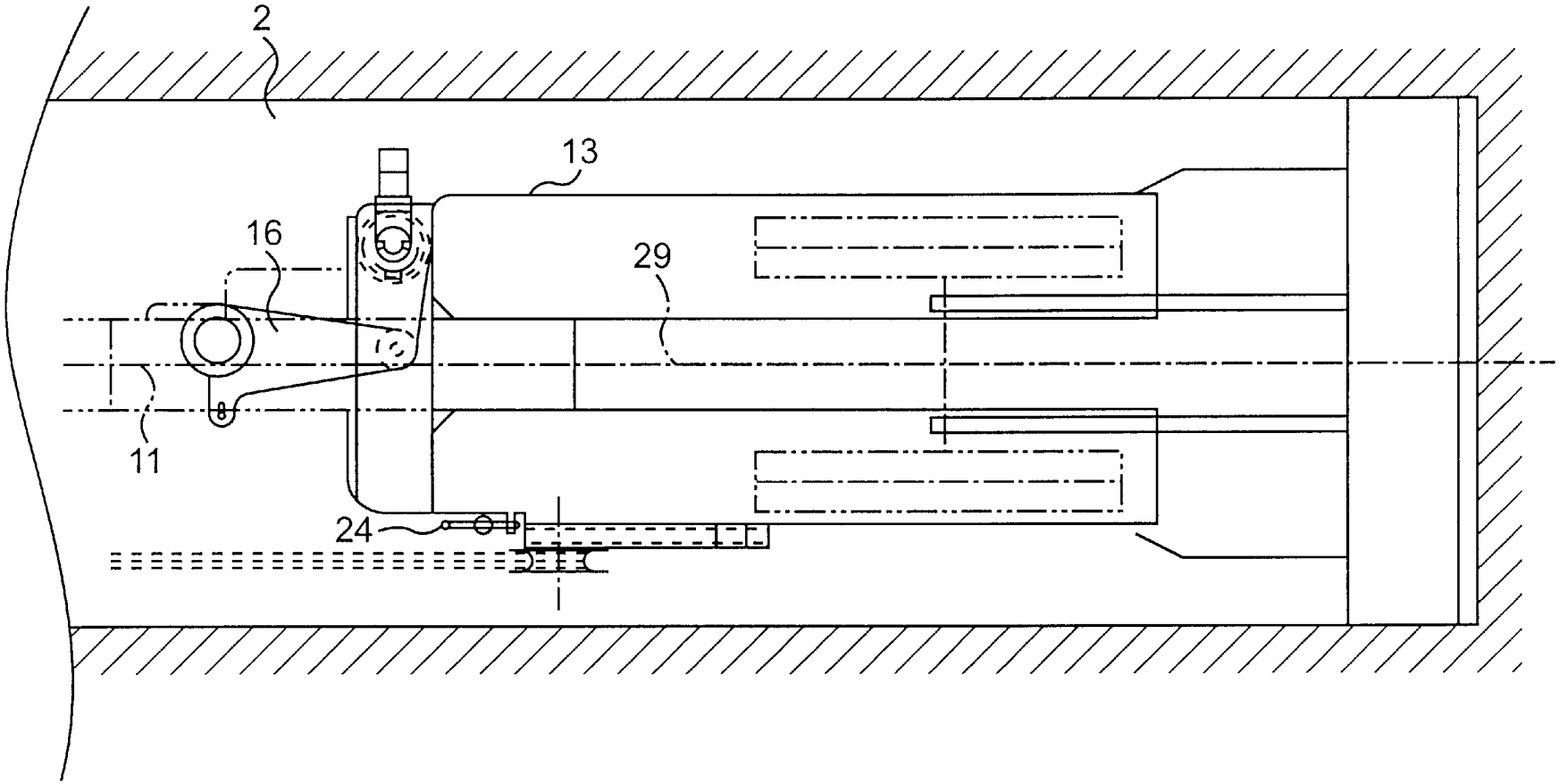
FIG. 6 is a schematic plan view of a remotely operated mining machine with the tow line diverter released and the tow line positioned at the center of the mining machine.
Figure 7:
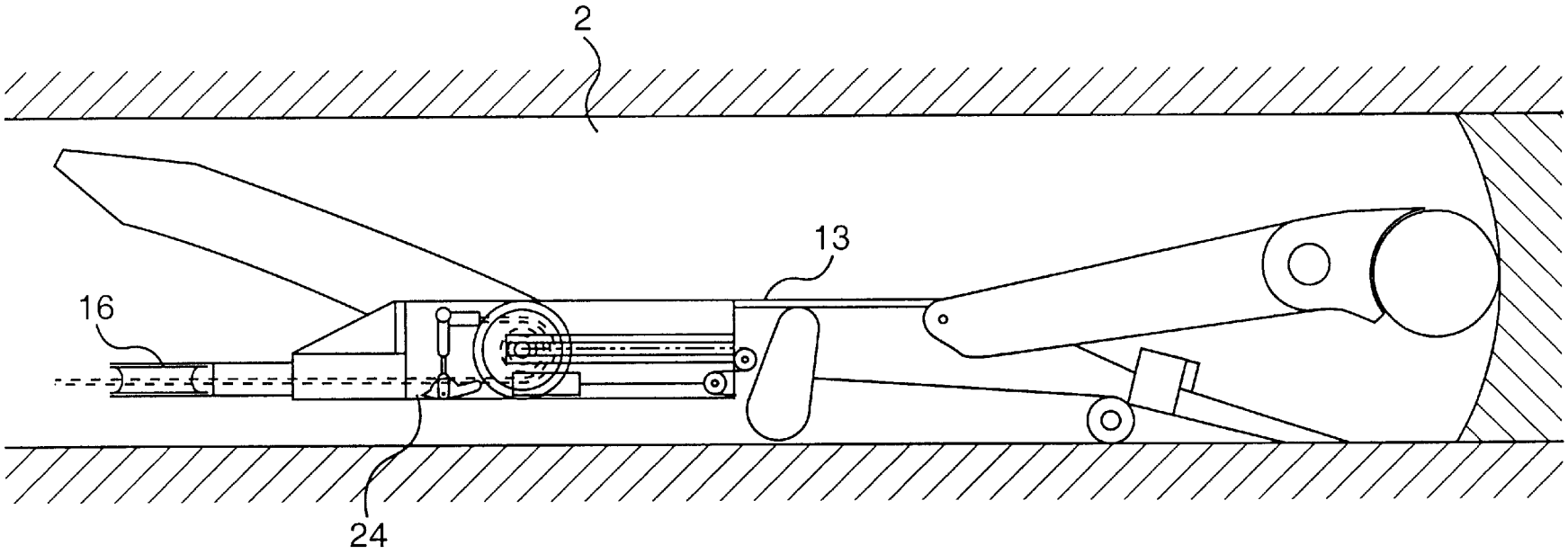
FIG. 7 is a schematic side view of a remotely operated mining machine shown in FIG. 6.

Referring to FIGS. 6 and 7, if the remote mining machine 13 breaks down and is unable to back out of the mine opening 2 on its own power, the locking mechanism 24 is disengaged from the diverter 16, allowing it to swing and align tow line 11 along the centerline 29 of the machine 13 and the tow line 11 can be used to pull the machine 13 from the mine opening 2.

Figure 8:
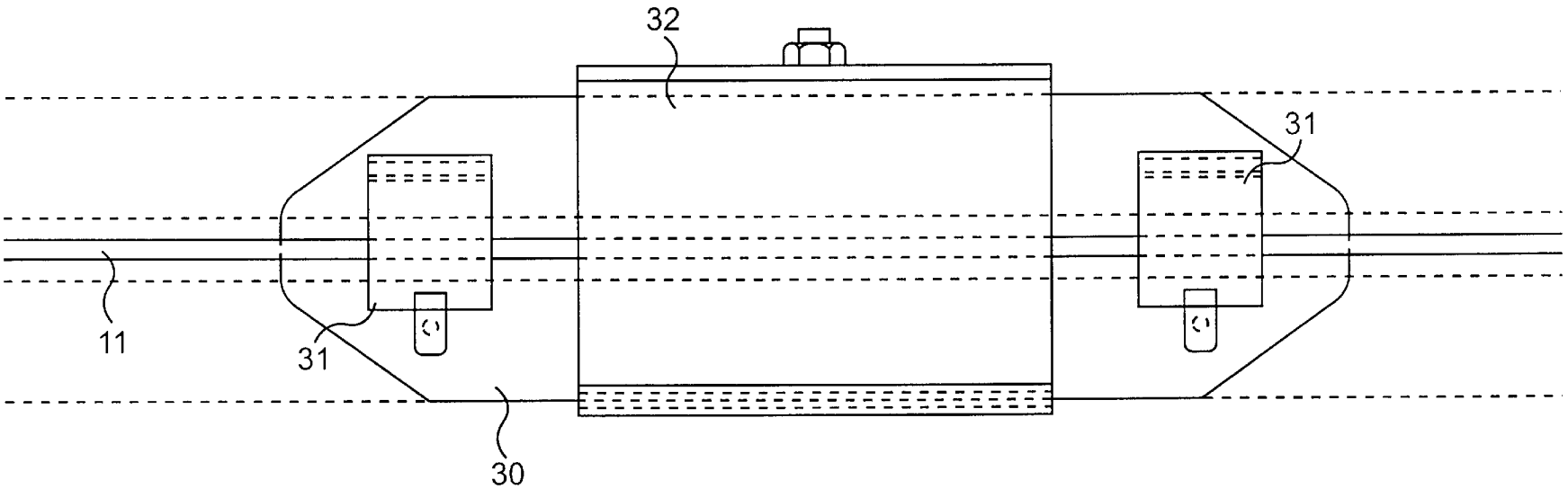
FIG. 8 is a schematic plan view of a preferred embodiment of a tow line-mounted clamp for securing the service line to the tow line.
Figure 9:
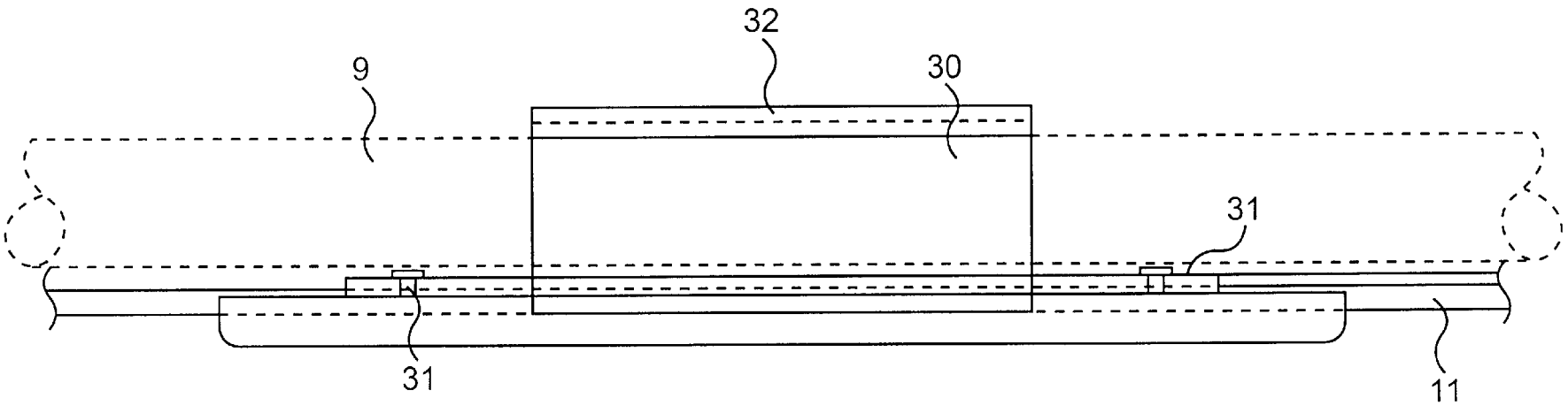
FIG. 9 is a schematic side view of a preferred embodiment shown in FIG. 8.
Figure 10:
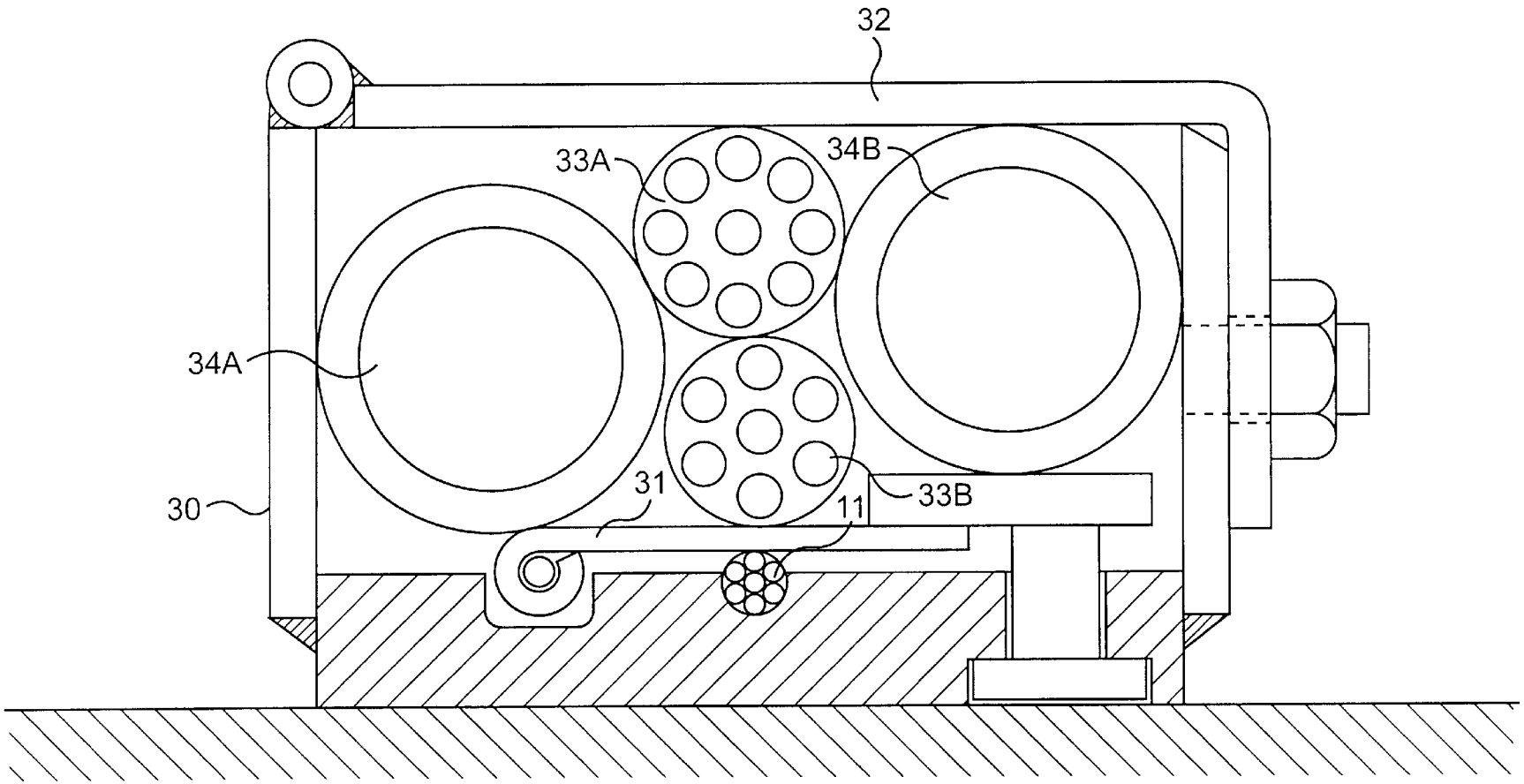
FIG. 10 is a schematic cross-sectional view of a preferred embodiment shown in FIG. 8.

Referring to FIGS. 8 through 10, service line 9 is clamped at regular intervals to a tow line 11 in a clamp 30. In this embodiment the clamp 30 comprises primary subclamps 31 that securely fasten the tow line to the body of the clamp 30, and mounting means 32 for the service line cables 33A and 33B and hoses 34A and 34B. As the tow line 11 is wound in and out of the mine opening 2, it carries service line cables 33A and 33B and hoses 34A and 34B into the mine opening 2.

Figure 11:
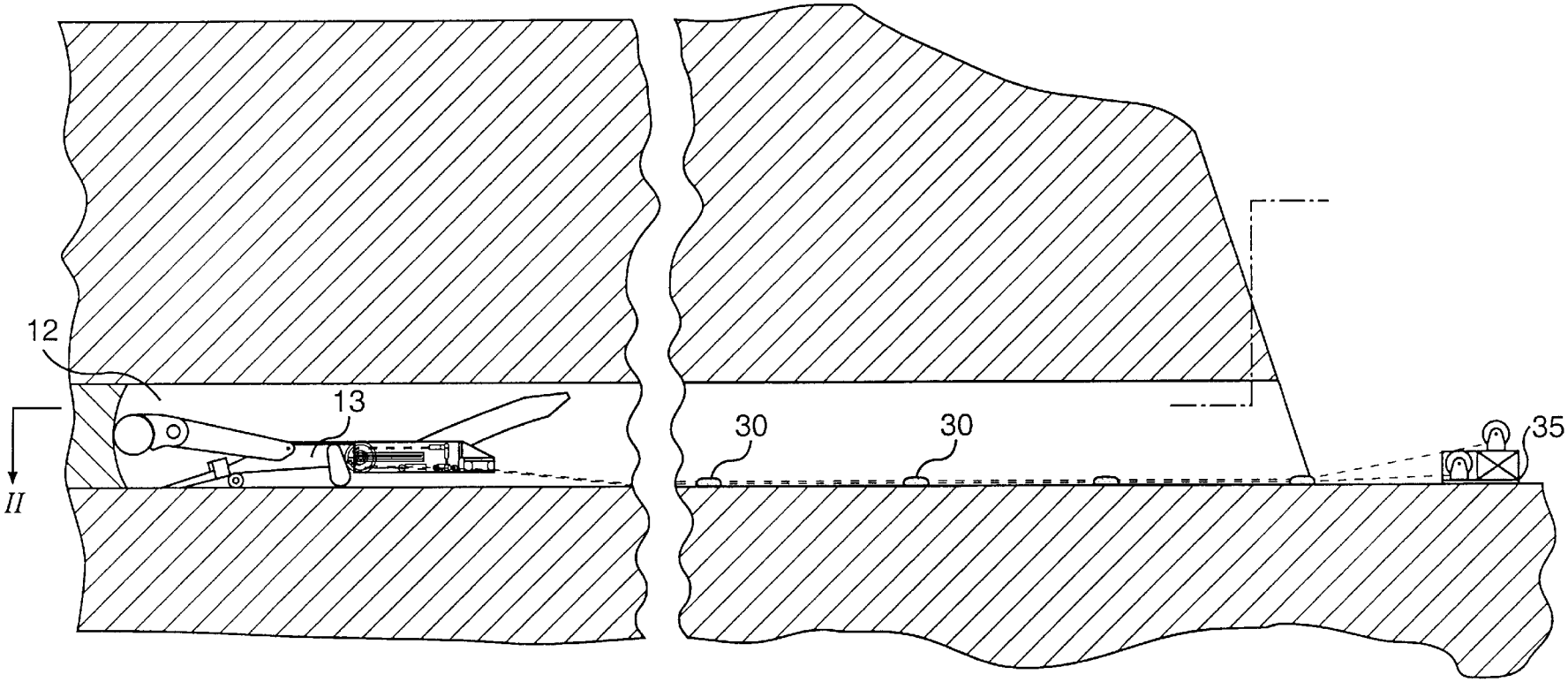
FIG. 11 is a schematic side view of a preferred embodiment of a service line assembly advancing into a mine opening during the remote operation with LHD on the surface.
Figure 12:
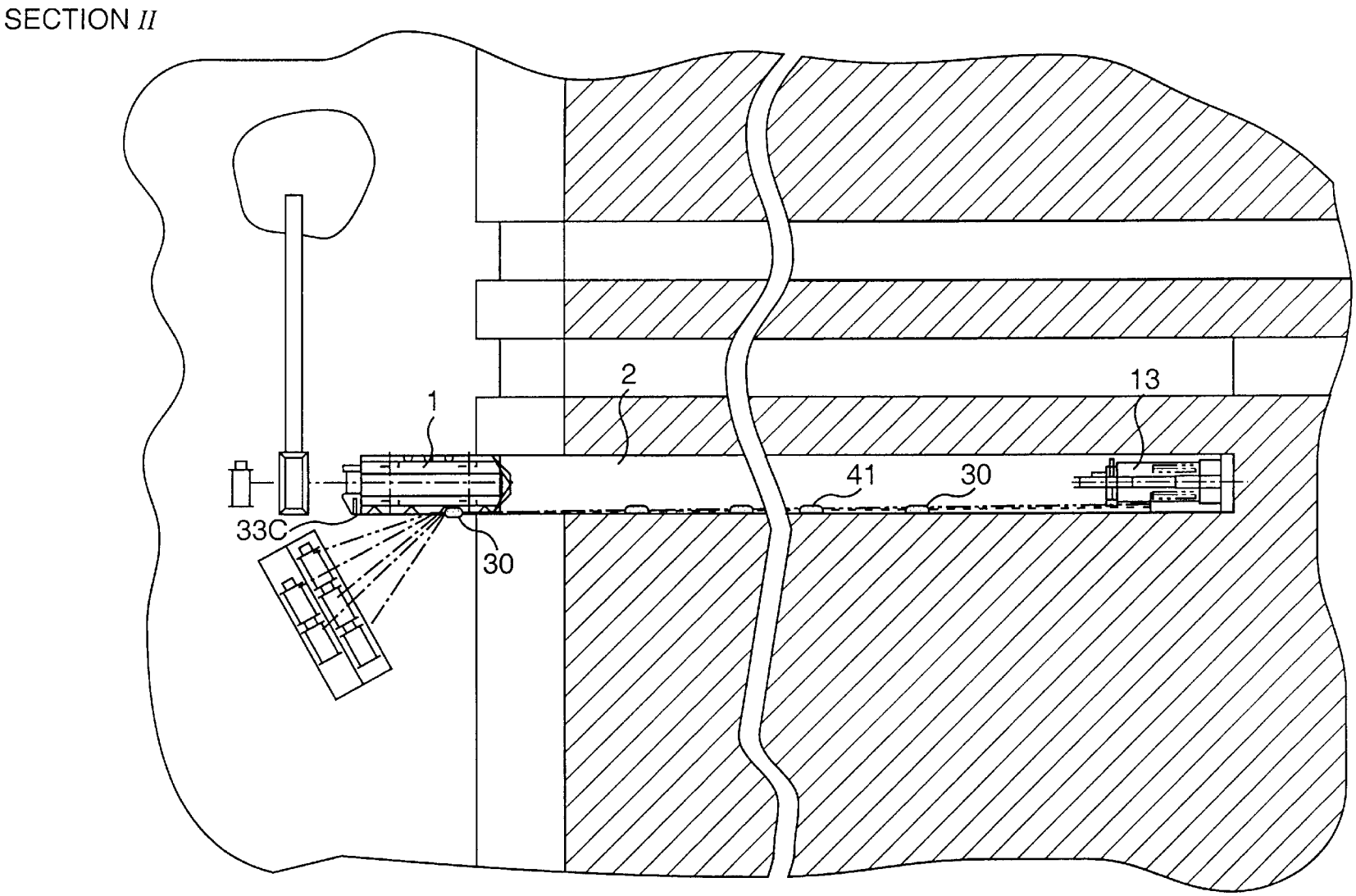
FIG. 12 is a schematic plan view of a preferred embodiment shown in FIG. 11 with LHD on the surface.
Figure 13:
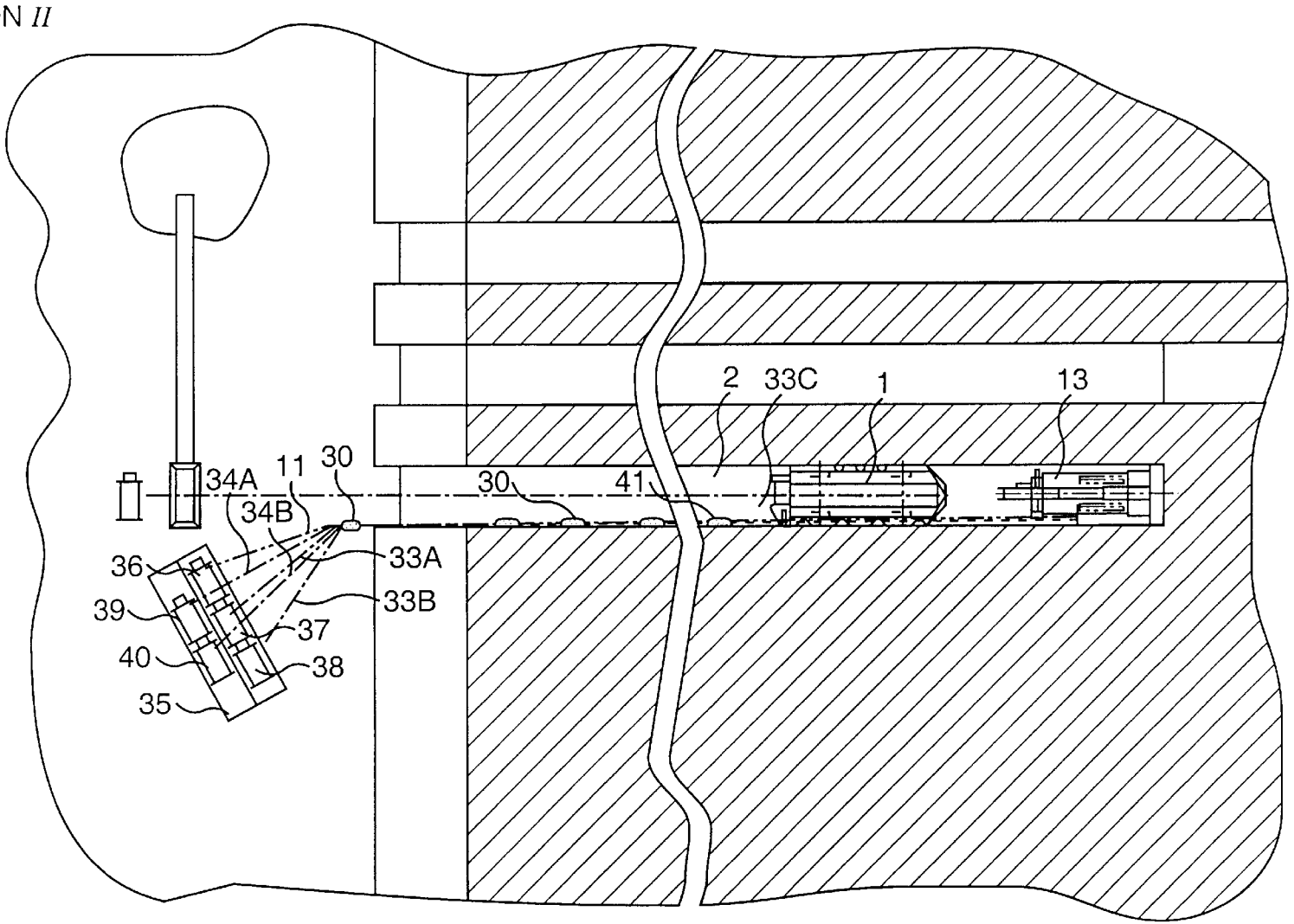
FIG. 13 is a schematic plan view of a preferred embodiment shown in FIG. 11 with LHD in the mine opening.

Referring to FIGS. 11 through 13, winch assembly 35 contains tow line winder 36, mining machine power cable winder 37, LHD power cable winder 38, water hose winder 39 and compressed air hose winder 40. As tow line 11 is advanced into the mine opening 2, the mining machine cable 33A, the LHD cable 33B, the water hose 34A and the compressed air hose 34B are unwound from winders 37, 38, 39 and 40 and clamps 30 are installed, securely attaching them to the tow line 11 at regular intervals. When the mine opening 2 is completed, the process is reversed. When the haulage distance of LHD 1 reaches the length of the LHD trailing cable 33C, a holdback clamp 41, which is a clamp containing an electrical connector for connecting the LHD cable 33B to the LHD trailing cable 33C is installed on the tow line 11. The holdback clamp 41 is advanced into the mine opening 2 with the tow line 11, thus maintaining a fixed distance from the mining machine 13. This allows the LHD 1 to wind the LHD trailing cable 33C in, while advancing up to the position of the special holdback clamp 41, and unwind the LHD trailing cable 33C while it is advancing away from the special holdback clamp 41, thus allowing LHD 1 to haul to a distance equal twice the length of the LHD trailing cable 33C.

Numerous modifications and adaptations of the present invention will be apparent to those skilled in the art and it is intended by the following claims to cover all such modifications, which fall within the true spirit of this invention.

What is claimed is:

1. A method of moving a service line connected between a winder and a remotely operated mining machine in a mine opening, comprising:

a) paying out a length of the service line from the winder;

b) taking up a length of the service line at the remotely operated mining machine independently of motion of the remotely operated mining machine; and c) paying out the service line from the remotely operated mining machine as the mining machine advances within the mine opening.

2. The method of claim 1 wherein the service line includes a tow line operatively connected thereto and said method further comprises:

a) paying out a length of service line from the winder while paying out a length of the tow line;

b) taking up a length of the service line at the remotely operated mining machine by taking up a length of the tow line;

c) paying out a length of the service line at the remotely operated mining machine while paying out a length of the tow line as the mining machine advances within the mine opening.

3. The method of claim 2 wherein a haulage vehicle is positioned between the winder and the remotely operated mining machine, and further comprising:

a) diverting the service line and the tow line to the side of the mine opening and out of the path of the haulage vehicle such that the tow line and the service line do not cause interference with the path of a haulage vehicle.

4. The method of claim 3 where the mining machine includes a diverter and further positioning the diverter to divert the service line and the tow line.

5. The method of claim 2 wherein one end of the tow line is attached to a tow line winch on the mining machine and the other end is attached to the winder remote from the mining machine, further comprising:

a) advancing the tow line towards the mining machine by taking up the tow line on the tow line winch;

b) withdrawing the tow line from the mining machine by taking up the tow line on the winder.

6. A method of retrieving a remotely operated mining machine including a tow line diverter and a locking mechanism which can engage the diverter and hold it in a side position comprising:

a) actuating the locking mechanism to disengage the tow line diverter from the tow line diverter's side position, b) rotating the tow line diverter so that the tow line pays out from a central position of the mining machine, c) withdrawing the tow line from the mine opening thereby retrieving the mining machine therefrom.

7. A mining system, including a remotely operated mining machine and a service line take up mechanism external to the mining machine and operatively connected to a service line, the mining machine being capable of advancing within a mine opening, comprising;

a) a service line take up positioned on the mining machine to take up a length of service line independently of the motion of the mining machine;

b) a tow line take up positioned on the mining machine to take up a length of tow line independently of the motion of the mining machine.

8. The mining system of claim 7 further comprising:

a) a tow line diverter.

9. The mining system of claim 8 further comprising:

a) a locking mechanism.

* * * * *